United States Patent [19]

Kessler

[11] 4,164,599

[45] Aug. 14, 1979

[54] WEATHER STRIP AND METHOD OF ITS MANUFACTURE

[76] Inventor: Milton Kessler, 6690 Harrington Ave., Youngstown, Ohio 44512

[21] Appl. No.: 818,425

[22] Filed: Jul. 25, 1977

[51] Int. Cl.[2] ..... D04H 11/00

[52] U.S. Cl. ..... 428/92; 49/475; 49/489; 156/72; 156/73.2; 156/272; 156/273; 428/96

[58] Field of Search ..... 428/85, 88, 89, 90, 428/96, 358; 49/475, 484, 492, 493, 489; 156/72, 73.2, 272, 273

[56] References Cited

U.S. PATENT DOCUMENTS

| | | | |
|---|---|---|---|
| 3,404,487 | 10/1968 | Johnson | 49/475 |
| 3,836,421 | 9/1974 | Terry | 428/88 |

*Primary Examiner*—Marion E. McCamish
*Attorney, Agent, or Firm*—Burge & Porter Co.

[57] ABSTRACT

A weather strip has an elongate base with one or more rows of fibers adjacent an elongate windbreak. The elongate windbreak is formed from a row of individual fibers which are bonded together during the process of manufacture. The bonding of fibers to form a windbreak is accomplished by exposing the base and fiber rows to an application of energy, such as radiofrequency energy, sufficient to bond the windbreak fibers together and insufficient to bond the remaining fibers together.

23 Claims, 7 Drawing Figures

WEATHER STRIP AND METHOD OF ITS MANUFACTURE

BACKGROUND OF THE INVENTION

1. Field of the Invention

The present invention relates to a weather strip of the pile type in which a plurality of fibers are carried by a base strip and a windbreak is formed among the fibers by bonding selected fiber portions together.

2. Prior Art

Weather strips of the pile type having a pile material which runs longitudinally of a base strip are known. The base strip is utilized to support the pile material and may be secured in a channel formed in a wood, metal, or plastic support structure to support the pile material in an attitude projecting outwardly from a surface of the supporting structure.

The base strip is typically formed from woven fabric, plastic or metal. The upstanding fibrous pile material is either woven or stitched into the base strip or is provided as a flocking adhesively secured to the base strip. Weather strip structures of this type are described in U.S. Pat. Nos. 3,002,253; 3,224,047; 3,616,137; 3,836,421; and 3,935,043.

Another type of proposed weather strip material incorporates a flexible, impermeable plastic sheet material in the center of or along an edge of the pile material in order to support the upstanding fibers and to provide a wind, water, and vapor barrier inside or immediately adjacent the pile material. Typical disclosures of this type are found in U.S. Pat. Nos. 3,175,256; 3,266,190; 3,404,487, and 3,745,053.

While it is desirable to include a windbreak among the fibers of the pile material, previous proposals for including various types of barriers on pile type weather strips have required that a material forming the barrier be separately positioned among or alongside the fibers and properly secured in place. These additional fabrication steps have added undesirably to the cost and difficulty of manufacturing weather strips.

SUMMARY OF THE INVENTION

The present invention overcomes the foregoing and other drawbacks of prior proposals by providing a weather strip in which selected portions of the pile fibers are bonded together to provide a windbreak.

In the preferred practice of the present invention, a weather strip includes an elongate base strip which may be of any suitable type, such as woven fabric or plastic sheeting. Upstanding fibers are secured to the weather strip base in any suitable fashion. In the case of a woven fabric base strip, the upstanding pile material is typically woven or stitched through the fabric base in much the same manner that a carpet pile is woven, as is well known in the prior art. In the case of a plastic base strip, the upstanding pile material is conveniently made by adhesively securing or otherwise bonding a flocking material to the base strip, as is also well known in the prior art.

After the fibers are secured to the base strip, selected adjacent portions of the fibers are bonded together to form a windbreak. The selected fibers which are bonded to form the weatherbreak are preferably formed from a different material than the fibers which are not bonded, and/or are coated with a bonding agent to enhance their bonding.

The materials selected for the unbonded pile material should have the characteristics of resiliency and memory sufficient to return to its original upstanding position even though it is deformed for extended periods in use, as may occur between a door and door frame, a window and window frame, or other like applications where weather strip material is used. In addition, the unbonded fibers should not be affected by the technique to bond the bondable fibers together. Accordingly, the fibers of the bonded and unbonded sections preferably differ in a respect related to the bonding technique. For example, the unbonded fibers may be selected from a group having the characteristic that the exterior surface thereof lacks external adhesiveness in a temperature range where the bondable fibers provide a measure of external adhesiveness. Suitable fibers for the unbonded rows include natural fibers such as wool, goat hair and the like, and synthetic fibers such as polyethylene, polypropylene, and the like.

The bondable fibers may be uncoated or coated. Uncoated fibers which provide a measure of external adhesiveness are nylon and polyvinyl chloride filaments. Coated fibers which provide a measure of external adhesiveness are nonbondable fibers, such as those previously mentioned, which have been coated with a material providing the desired amount of external adhesiveness.

The bondable and unbondable fibers are preferably applied to the weather strip base in separate side-by-side rows, and the bondable fibers are then bonded together. Bonding is preferably effected by exposing weather strip and rows of fibers to an application of energy, such as radiofrequency energy, sufficient to cause the bondable fibers to exhibit a degree of external adhesiveness whereby adjacent ones of these fibers adhere together, and insufficient to bond the remaining fibers together.

In the case of coated fibers, it may be desirable to add to the coating a material susceptible to heating by radiofrequency or other electromagnetic energy. The material is conveniently in particulate form and may be incorporated in the coating materials in a quantity sufficient to produce a desired heating action.

As will be apparent from the foregoing summary, it is an object of the present invention to provide a novel and improved weather strip.

It is a further object to provide a novel and improved method of manufacturing weather strip materials.

These and other objects and a fuller understanding of the invention described and claimed in the present application may be had by referring to the following description and claims taken in conjunction with the accompanying drawing.

DESCRIPTION OF THE PREFERRED EMBODIMENTS

Figure 1:
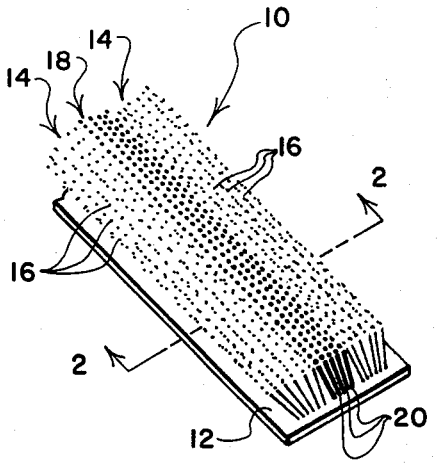
FIG. 1 is a perspective view of a portion of a weather strip embodying features of this invention at an intermediate stage of its manufacture.
Figure 2:
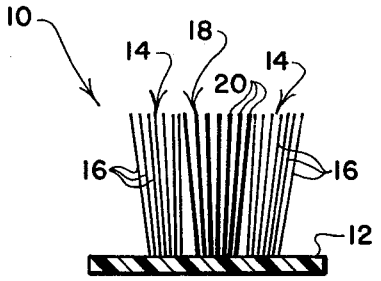
FIG. 2 is a transverse sectional view as seen from a plane indicated by a line 2—2 in FIG. 1.

Referring to FIGS. 1 and 2, a partially completed weather strip or weather strip blank 10 includes a base strip 12 which may be of woven fabric but which is more conveniently illustrated as being of plastic strip material. A pair of first rows 14 of fibers 16 which do not exhibit any substantial measure of external adhesiveness during bonding process of this invention are secured to the base strip 12. A second row 18 of fibers 20 which exhibit a significant degree of external adhesiveness under the bonding conditions employed is also secured to the base strip 12.

As mentioned previously, the base strip 12 may be formed of relatively flexible material such as woven fabric with the fibers 16, 20 woven or stitched into the matrix of the base strip. When stitching the rows 14, 18, it will be apparent that these separate rows may be applied contemporaneously thereby avoiding a series of different assembly steps. In the alternative, and as illustrated in the draing, the base strip 12 may be formed from relatively stiff or rigid material such as an essentially imperforate plastic strip having the fibers 16, 20 bonded thereto as may be accomplished in a conventional manner as is well known in the prior art.

The fibers 16 are selected to have a substantial degree of resiliency and memory sufficient to return fibers 16 to the upstanding position of FIG. 2 even though the fibers 16 are deformed during extended periods of use, as typically occurs in the normal use of weather strip material. Another criteria for selecting the particular material of the fibers 16 is that this material should not be affected by the technique to bond the bondable fibers 20 together. Thus, fibers 16 differ from the fibers 20 in a manner related to the bonding technique.

The unbonded fibers 16 may be selected from a group having little or no external adhesiveness when subjected to an application of energy, such as may be used during a bonding step to cause the bondable fibers to bond together. Suitable fibers for the rows 14 include natural fibers such as wool, goat hair and the like, and synthetic fibers such as polyethylene, polypropylene, and the like.

In a similar manner, the fibers 20 may be selected from a relatively large group of suitable materials which are coated or uncoated. Uncoated fibers providing a significant measure of external adhesiveness under the bonding conditions of this invention are nylon and polyvinyl chloride filaments. Coated fibers providing a measure of external adhesiveness are normally unbondable fibers, such as those previously mentioned, which have been coated with a material providing the desired amount of external adhesiveness and which cause the coated fibers to adhere together when the weather strip blank 10 is subjected to an application of electromagnetic energy which causes these fibers to be heated sufficiently to bond together. Suitable coatings include a water emulsion of ethylene vinyl acetate such as is available under the designation Aircoflex 400, from Air Reduction Company of New York, New York, an epoxy having a cure rate proportional to temperature, and the like.

In the case of coated fibers, it may be desirable to add to the coating a mixture of materials susceptible to heating by radiofrequency or other electromagnetic energy. The material is conveniently in particulate form and may be incorporated in the coating materials in a quantity sufficient to produce a desired heating action. When added to the coating material or to an adhesive filament, the particulate material is typically as low as 10 to as high as 50 percent by weight with respect to the coating mixture or filament. Such material is termed a "susceptor" in the art, and may be responsive to the indirect application of heat in the form of an alternating magnetic field or radiofrequency energy. In this situation, the susceptor may consist of a material heated by conduction heating such as particles of iron oxide, preferably gamma $Fe_2O_3$, although other metals or ferrite particles may also be used satisfactorily. The incorporation of a particulate susceptor in coatings to materials normally deamed to be inefficiently heated is described in U.S. Pat. Nos. 3,652,361; 3,730,805 and 3,863,957.

Fibers selected for the rows 14, 18 may be of any suitable physical shape, texture, length and density commensurate with the proceeding requirements. Including in desired physical shapes are flat or twisted fibers, as well as flat or essentially circular monofilaments. Moreover, any number of rows 14, 18 may be utilized, and the fibers 16, 20 may be arranged in intermittent or alternate groups in each row.

Figure 3:
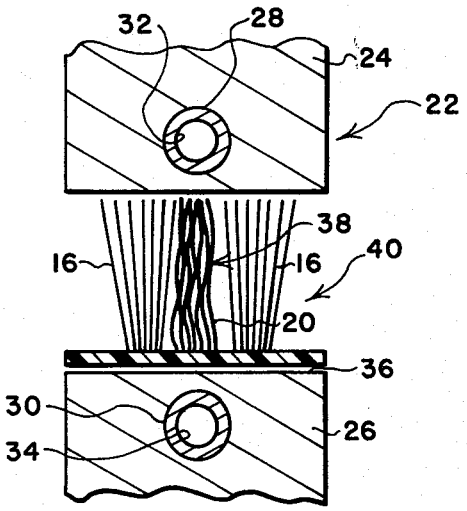
FIG. 3 is a sectional view similar to FIG. 3 of the weather strip during a bonding step.

After the weather strip blank 10 has been fabricated, it is passed through a radiofrequency energy generator designated generally by the numeral 22 in FIG. 3. The generator 22 comprises a pair of spaced shoes 24, 26 respectively providing induction coils 28, 30 therein. The coils 28, 30 have passages 32, 34 formed therein for the delivery of coolant, if desirable. The induction coils 28, 30 are energized by an unillustrated portion of the generator 22, which may be of any desired type, such as is available from Westinghouse Electric Corporation, Industrial Equipment Division, Sykesville, Md., under the model designation 10K68.

The weather strip blank 10 is delivered at a fairly rapid rate across an upper surface 36 of the shoe 26 and forms a completed weatherstrip 40. The fibers 20 are heated and preferentially adhered together during movement through the generator 22, while the unbondable fibers 16 remain unbonded whereby the bonded fibers 20 form a windbreak 38. The windbreak 38 is accordingly formed from a multiplicity of generally parallel fibers 20 which are bonded together. The windbreak 38 not only acts as a support for the fibers 16 when the weather strip 40 is used in a conventional environment, but also acts in some measure to prevent, air, water or vapor from traveling across the transverse dimension of the weather strip 40 when in use. The windbreak 38 need not be impermeable or imperforate to perform these functions.

Figure 4:
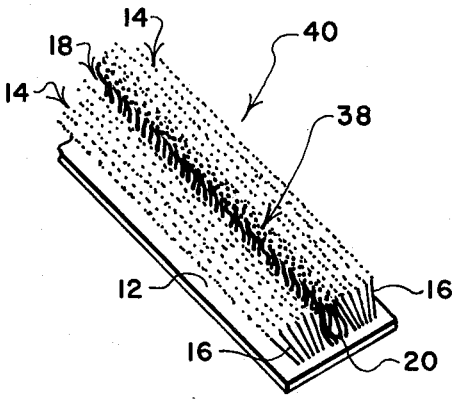
FIG. 4 is a perspective view of a portion of a weather strip in its completed form.
Figure 5:
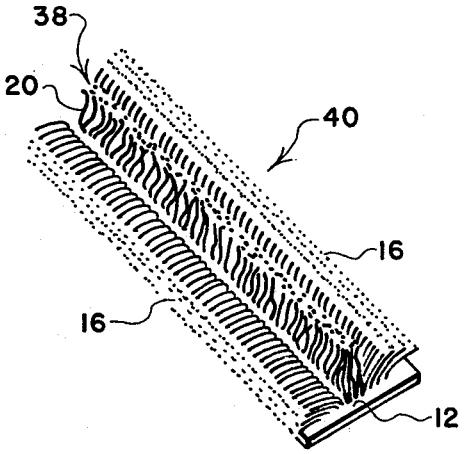
FIG. 5 is a perspective view of the completed weather strip of FIG. 4 with unbonded fibers being separated from bonded fibers to more completely illustrate the windbreak of this invention.

Referring to FIGS. 4 and 5, the weather strip 40 is illustrated in its completed condition with the row 18 of fibers 20 now constituting the windbreak 38. In FIG. 5, the fibers 16 have been folded downwardly to expose and illustrate the windbreak 38 more clearly.

Figure 6:
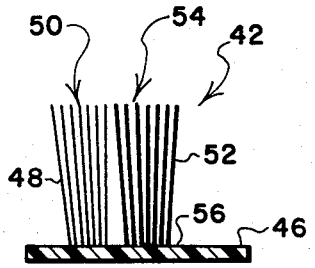
FIG. 6 is a sectional view of another embodiment of a weather strip blank prior to its completion of manufacture; and, FIG. 7 is a sectional view similar to FIG. 6 illustrating this embodiment of the weather strip in its completed form.
Figure 7:
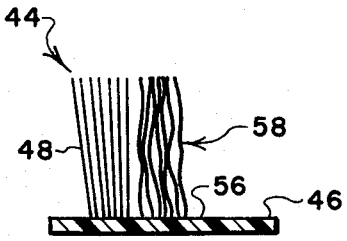

Referring to FIGS. 6 and 7, there is illustrated another embodiment of a weather strip of blank 42 which is ultimately transformed into a weather strip 44. The blank 42 comprises a base strip 46 having a plurality of unbondable fibers 48 arranged in a row 50 extending longitudinally of the strip 46. A plurality of bondable fibers 52 are arranged in a row 54 on one side of the row 50, leaving a section 56 of the base strip 46 free of upstanding fibers or pile material.

After the blank 42 is fabricated, it is delivered through a radiofrequency generator similar to that previously described in order to bond the fibers 52 together into a windbreak 58, as illustrated in FIG. 7.

As will be apparent from the foregoing description, the present invention provides a novel and improved weather strip and method of its manufacture, enabling a windbreak to be incorporated among the fibers of a pile type weather strip in a simpler, less expensive manner than has been provided in prior proposals. The system of the present invention is well adapted for use with a wide variety of bonding systems and with any of a large number of materials forming the base strip and pile fibers.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A weather strip, comprising:
(a) an elongate base strip;
(b) a first row, extending longitudinally along the base strip, of individual first fibers free to move relative to each other;
(c) a second row, extending longitudinally along the base strip, of second fibers bonded together to provide a windbreak;
(d) the first fibers exhibiting no significant measure of external adhesiveness in the presence of a selected application of energy;
(e) the second fibers exhibiting a significant measure of external adhesiveness in the presence of said selected application of energy; and,
(f) the second fibers being bonded together as the result of said selected application of energy.

2. The weather strip of claim 1 comprising a third row of individual fibers free to move relative to each other, the second row being between the first and third rows.

3. The weather strip of claim 1 wherein the second fibers are of a thermally bondable type and the first fibers are of a thermally non-bondable type, and said selected application of energy is operable to heat the second fibers to effect thermal bonding thereof.

4. The weather strip of claim 3 wherein the second fibers provide a significant measure of external adhesiveness at a predetermined temperature and the first fibers lack any significant measure of external adhesiveness at temperatures equal to or less than the predetermined temperature, and said selected application of energy is operable to heat at least the second fibers to at least the predetermined temperature.

5. The weather strip of claim 4 wherein the first fibers are selected from the group consisting of natural fibers, polyethylene and polypropylene.

6. The weather strip of claim 5 wherein the second fibers are selected from the group consisting of uncoated nylon and uncoated polyvinyl chloride filaments.

7. The weather strip of claim 5 wherein the second fibers comprise a thermally non-bondable fibers, the fiber being coated with a material providing the significant measure of external adhesiveness.

8. The weather strip of claim 1 wherein the second fibers are coated with a material which provides a significant measure of external adhesiveness when subjected to a selected application of energy, and the first fibers are not so coated.

9. The weather strip of claim 1 wherein the windbreak is permeable.

10. A weather strip, comprising:
(a) a base strip;
(b) a plurality of rows of fibers carried by the base strip;
(c) at least one of the rows being formed of first fibers which are free to move relative to each other; and,
(d) at least one other of the rows being formed of second fibers having selected portions thereof bonded together to provide a windbreak, the second fibers exhibiting a significant measure of external adhesiveness when subjected to a selected application of energy, the second fibers being bonded together as the result of said application of energy.

11. The weather strip of claim 10 wherein at least the selected portions of the second fibers have been coated with a material to enable them to exhibit a significant measure of external adhesiveness when subjected to the selected application of energy.

12. The weather strip of claim 10 wherein:
(a) the first fibers are of a type which do not exhibit a significant measure of external adhesiveness when subjected to the selected application of energy.

13. The weather strip of claim 12 wherein the base strip is elongate and the first and second fibers are arranged in separate rows extending longitudinally of the base strip.

14. The weather strip of claim 12 wherein the second fibers are arranged in at least one row among rows of the first fibers.

15. The weather strip of claim 14 wherein the first fibers are arranged in two spaced rows, and the second fibers are arranged in a third row located between the two rows of the first fibers.

16. The weather strip of claim 12 wherein the first fibers are selected from a group consisting of natural fibers, polyethylene and polypropylene.

17. The weather strip of claim 12 wherein the second fibers are selected from a group consisting of uncoated nylon and uncoated polyvinyl chloride filaments.

18. The weather strip of claim 12 wherein the windbreak is permeable.

19. A method of making a weather strip, comprising:
(a) providing an elongate base strip;
(b) affixing a longitudinally extending first row of first fibers to the base strip, the first fibers exhibiting no significant measure of external adhesiveness when subjected to a selected application of energy;
(c) affixing a longitudinally extending second row of second fibers to the base strip, the second fibers exhibiting a significant measure of external adhesiveness when subjected to said selected application of energy;
(d) applying said selected application of energy to at least the second fibers to bond the second fibers together while maintaining the first fibers unbonded.

20. The method of claim 19 wherein the step of applying energy comprises exposing at least the second fibers to radio-frequency energy.

21. A method of making a weather strip, comprising:

(a) providing a base strip;

(b) affixing at least one row of first fibers to the base strip;

(c) affixing at least one row of second fibers to the base strip, the second fibers being capable of exhibiting a significant measure of external adhesiveness when subjected to a selected application of energy; and, (d) applying said selected application of energy to the second fibers to effect bonding of at least selected portions of the second fibers together to provide a windbreak, while leaving the first fibers free to move independently.

22. The method of claim 21 wherein the step of affixing a plurality of first fibers includes affixing fibers of a type which do not exhibit a significant measure of external adhesiveness when subjected to said selected application of energy.

23. The method of claim 22 wherein the steps of affixing the first and second fibers to the base strip include the step of positioning the row of second fibers in at least one row among rows of the first fibers such that the resulting windbreak is located among the first fibers.

* * * * *